United States Patent [19]

Takada

[11] Patent Number: 4,743,805

[45] Date of Patent: May 10, 1988

[54] ANODE ASSEMBLY OF MAGNETRON AND METHOD OF MANUFACTURING THE SAME

[75] Inventor: Kousuke Takada, Kawasaki, Japan

[73] Assignee: Kabushiki Kaisha Toshiba, Kawasaki, Japan

[21] Appl. No.: 903,726

[22] Filed: Sep. 5, 1986

[30] Foreign Application Priority Data

Sep. 9, 1985 [JP] Japan ..... 60-198926
Sep. 9, 1985 [JP] Japan ..... 60-198927

[51] Int. Cl.[4] ..... H01J 25/587

[52] U.S. Cl. ..... 315/39.75; 315/39.77; 445/35

[58] Field of Search ..... 315/39.51, 39.63, 39.69, 315/39.75, 39.77; 445/35, 66

[56] References Cited

U.S. PATENT DOCUMENTS 3,875,469 4/1975 Sato et al. ..... 315/39.51
4,056,756 11/1977 Derby ..... 315/39.51

FOREIGN PATENT DOCUMENTS 53-85150 7/1978 Japan .
56-27658 7/1981 Japan .
56-162850 12/1981 Japan .
57-18664 4/1982 Japan .
0017836 1/1985 Japan ..... 315/39.51

*Primary Examiner*—David K. Moore
*Assistant Examiner*—T. C Salindong
*Attorney, Agent, or Firm*—Cushman, Darby & Cushman

[57] ABSTRACT

An anode assembly of a magnetron includes an anode cylinder and a plurality of anode vanes arranged in the cylinder. The cylinder has a plurality of projections protruding from the inner surface thereof. A connecting end portion of each vane is engaged with the inner surface of the cylinder and located between the corresponding projections. The connecting end portion is mechanically fixed to the inner surface of the cylinder by caulking the projections, and electrically connected to the cylinder by soldering. In manufacturing of the assembly, the vanes are fixed to the cylinder by caulking the projections while they are positioned with respect to the cylinder by a positioning jig. Then, the vanes and cylinder are soldered to each other after removing the positioning jig from the assembly.

9 Claims, 9 Drawing Sheets

ANODE ASSEMBLY OF MAGNETRON AND METHOD OF MANUFACTURING THE SAME

BACKGROUND OF THE INVENTION

The present invention relates to an anode assembly of a magnetron and a method of manufacturing the same.

An anode assembly of a magnetron conventionally has an anode cylinder and a plurality of anode vanes radially fixed to the inner surface of the anode cylinder. Every other vanes are electrically short-circuited by a pair of strap rings. The anode assembly having this structure is manufactured in the following manner. First, a plurality of copper anode vanes are positioned within a copper anode cylinder by a couple of positioning jigs. Subsequently, silver solders are provided at connecting portions of the anode cylinder and the vanes, and the anode cylinder and the vanes are placed in a high-temperature furnace for a predetermined period of time so that they are soldered with each other.

When an anode assembly is manufactured in accordance with the above procedure, a couple of positioning jigs to be placed in a furnace together with the anode cylinder and the vanes are inevitably required for every anode assembly. As a result, when, e.g., magnetrons for electronic ovens are mass-produced on a large scale, a large number of jigs are required, resulting in high facility costs. Inversely, when the number of jigs is small, the manufacturing efficiency is decreased. The positioning jig is heated to about 900° C. together with an anode assembly. Therefore, the jig must be formed of a material which is durable against repeated use at high temperatures, has small changes in size, and has a small thermal expansion coefficient. A jig satisfying these conditions is expensive and can be easily worn. A positioning jig generally has vane mount grooves. Each groove is formed to have a larger width than the thickness of the vane to allow easy mounting of the anode vane and in consideration of the thermal expansion of the jig and the vane in the soldering step. Therefore, even when the positioning jig is used, the positional relationship between adjacent vanes and, more specifically, the gap between distal end portions of the adjacent vanes which influences the high-frequency characteristics of the resonant cavity most cannot be set with high precision.

Japanese Patent Publication No. 57-18664 discloses a manufacturing method wherein an anode assembly is soldered in the soldering step without using a positioning jig. According to this manufacturing method, the connecting portions of the vanes and the anode cylinder are preliminarily fixed by welding prior to soldering of the vanes to the anode cylinder. Thereafter, these constituent components are soldered without using a jig. This manufacturing method can eliminate the drawbacks described above. However, when preliminary fixing is performed by, e.g., laser welding, welding with high bonding strength cannot be achieved since both the anode cylinder and vane are made of copper having a considerably high thermal conductivity. In addition, thermal strain tends to locally occur at the connecting portions during welding, and the gap between the adjacent vanes cannot always be set with high precision. The above manufacturing method thus still poses a problem to be solved.

SUMMARY OF THE INVENTION

The present invention has been made in view of the above situation and has as its object to provide an anode assembly of a magnetron which maintains the positional relationship between adjacent anode vanes at high precision, and a method of manufacturing the same.

In order to achieve the above object, an anode cylinder has a plurality of vane fixing projections protruding from its inner surface. One end portion of each anode vane is engaged with the corresponding projections. The vane is mechanically fixed to the anode cylinder by caulking the projections, and is electrically connected thereto by soldering.

The manufacturing method according to the present invention comprises the steps of: preparing an anode cylinder and a plurality of plate-like anode vanes; forming a plurality of projections on the anode cylinder which protrude from an inner surface of the anode cylinder; holding the anode vanes at predetermined positions with respect to the anode cylinder by a positioning jig and engaging an end portion of each of the anode vanes with the inner surface of the anode cylinder such that the end portion is located between the corresponding projections; caulking the projections while holding the anode vanes with the positioning jig so as to mechanically fix the anode vanes to the anode cylinder; removing the jig from the anode vanes; and soldering the fixed end portion of each of the anode vanes to the anode cylinder, thereby electrically connecting each of the anode vanes to the anode cylinder.

BRIEF DESCRIPTION OF THE DRAWINGS

FIG. 2 is a sectional view taken along the line II—II of FIG. 1, FIG. 3 is a partial enlarged perspective view of the anode assembly, FIG. 4 is a perspective view of an anode vane, and FIG. 5 is a sectional view taken along the line V—V of FIG. 1;

FIGS. 6 to 24 show the steps of manufacturing the anode assembly shown in FIG. 1, in which FIGS. 6 and 7 are perspective views, respectively, showing the steps of manufacturing the anode cylinder, FIG. 8 is a partially sectional side view of the anode cylinder, FIG. 9 is a partially sectional side view of the anode cylinder for showing the step of forming projections, FIG. 10 is a perspective view of a strap ring material, FIGS. 11 and 12 are perspective views, respectively, of inner and outer strap rings, FIGS. 13 to 15 are perspective, partially sectional plan, and longitudinal sectional views, respectively, of a jig and anode assembly when the jig is open, FIGS. 16 and 17 are partially sectional and longitudinal sectional views of the jig and anode assembly when the jig is closed, FIG. 18 is a perspective view of the anode assembly showing the caulking step, FIG. 19 is a plan view of the anode cylinder in an open state, FIG. 20 is a plan view of the strap ring in an open state, FIG. 21 is a perspective view of the anode assembly on which solders are placed, FIG. 22 is a perspective view of a solder, and FIGS. 23 and 24 are cross-sectional and partially sectional side views, respectively, showing the anode assembly mounted on a regulating jig;

DETAILED DESCRIPTION OF THE PREFERRED EMBODIMENT

The embodiment of the present invention will be described in detail with reference to the accompanying drawings.

Figure 1:
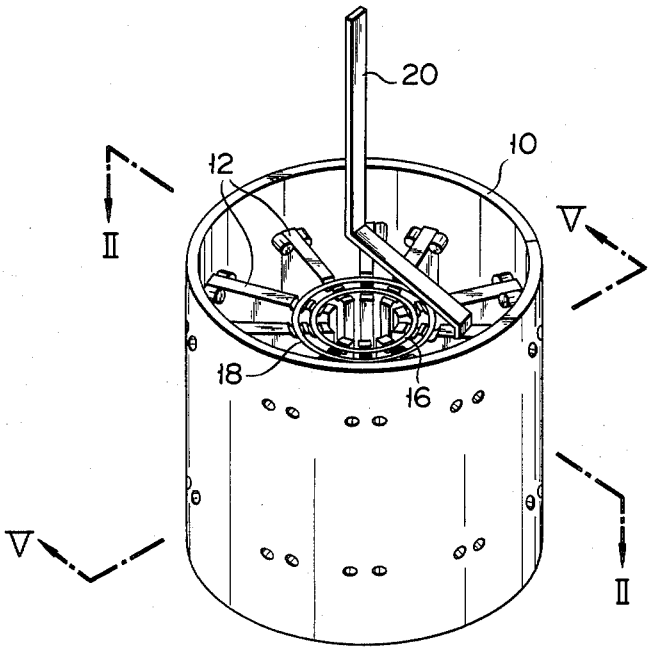
FIGS. 1 to 5 show an anode assembly according to an embodiment of the present invention, in which a perspective view of the anode assembly.
Figure 2:
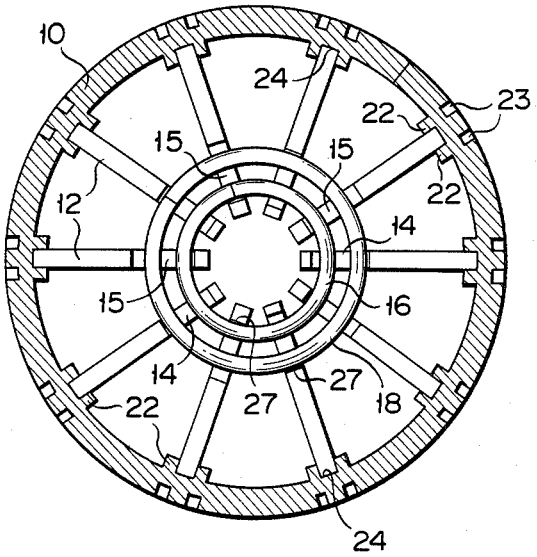
Figure 3:
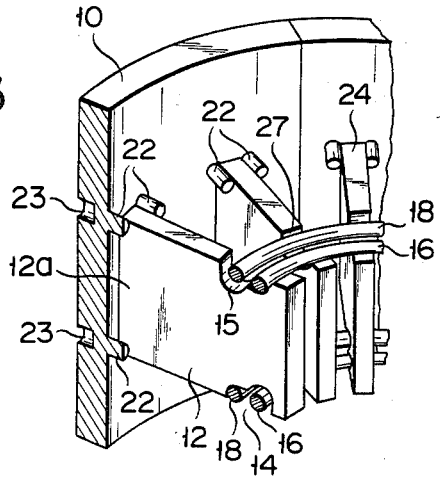

As shown in FIGS. 1 to 3, the anode assembly of a magnetron according to the present invention has copper anode cylinder 10 and a plurality of copper anode vanes 12 arranged in cylinder 10. Rectangular vanes 12 extend from the inner surface of cylinder 10 toward its center, and are arranged at equal angular intervals along the circumferential direction of cylinder 10. Strap ring mount grooves 14 and 15 are formed in each of the upper and lower edges of the extended end portions of each vane 12. Inner and outer strap rings 16 and 18 are mounted on grooves 14 and 15. Each of every other vane 12 is electrically short-circuited by strap rings 16 and 18, respectively. One end of antenna lead 20 is connected to one vane 12 and lead 20 extends upward from anode cylinder 10.

More particularly, cylinder 10 has a plurality of columnar projections 22 extending from its inner surface. Projections 22 are formed by pressing the wall of cylinder 10 from the outside, forming in the wall holes 23 having a depth about half the thickness of the wall, and simultaneously forming holes 23. Projections 22 are formed at positions on the inner surface of cylinder 10 at which anode vanes 12 are to be fixed. A pair of projections 22 are formed to correspond to each of the upper and lower portions of single vane 22. In the embodiment, projections 22 are arranged to engage with four corners of the proximal end portions of vanes 12, i.e., four corners of connecting end portion 12*a* to be fixed to the inner surface of cylinder 10. Each vane 12 is arranged such that the four corners of its connecting end portion 12*a* are engaged with corresponding projections 22, and is mechanically fixed to cylinder 10 by caulking projections 22. Furthermore, end portion 12*a* of each vane 12 is soldered to the inner surface of cylinder 10 with an appropriate solder material such as silver solder, and is thus electrically connected to cylinder 10. Reference numeral 24 denotes a solder portion. In this manner, each vane 12 extends along the axis of cylinder 10 and radially from the inner surface of cylinder 10 to its center. An electron-emissive cathode assembly (not shown) is provided in the space defined by the extending end faces of vanes 12 to be separated therefrom by a predetermined distance. An electron active space is thus defined between the cathode assembly and the vane extending end faces.

Figure 4:
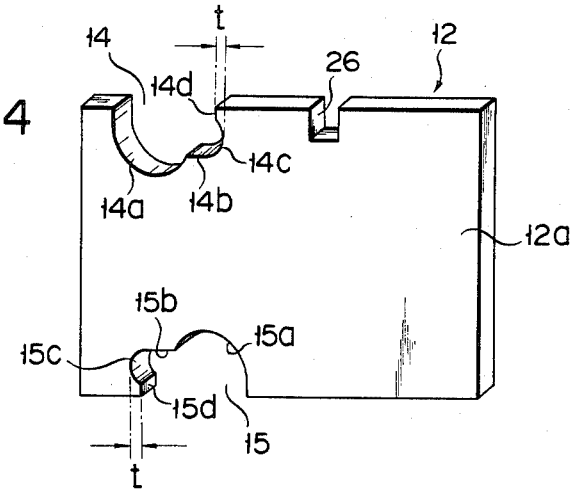

As shown in FIG. 4, strap ring mount groove 14 formed in each vane 12 has first groove portion 14*a* positioned on the extending end side of vane 12 and second groove portion 14*b* continuous with portion 14*a* and positioned on the proximal end side of vane 12. First groove portion 14*a* has a large size to allow a strap ring to pass therethrough in a non-contact manner. Second groove portion 14*b* has a shape and a size to substantially correspond to the section of the strap ring. Overhang portion 14*d* extending toward first groove portion 14*a* by length t of about 0.3 mm from inner portion 14*c* of second groove portion 14*b* is formed in the vicinity of second groove portion 14*b*. Mount groove 15 has first groove portion 15*a*, second groove portion 15*b*, inner portion 15*c*, and overhang portion 15*d*, in the same manner as mount groove 14. However, first groove portion 15*a* of groove 15 is formed on the proximal end side of vane 12, and second groove portion 15*b* thereof is formed on the extending end side of vane 12. Slit 26 for connecting antenna lead 20 is formed in the upper end of one of vanes 12.

Figure 5:
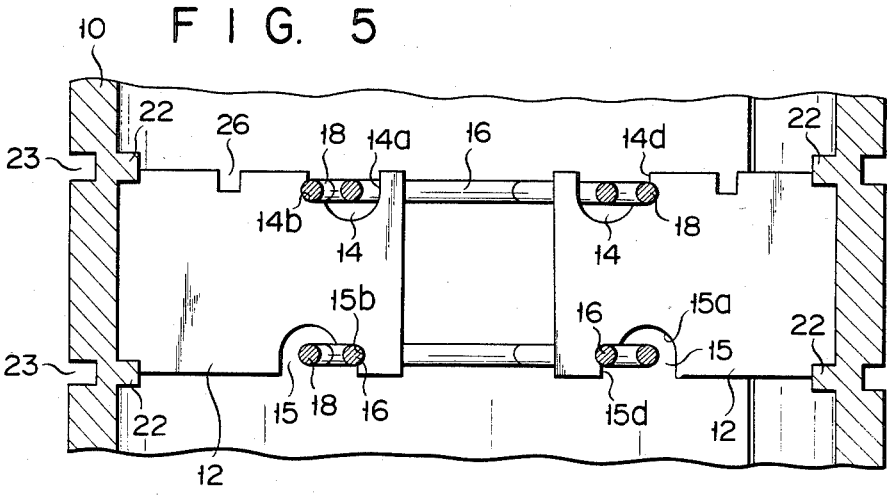

As seen from FIG. 2, vanes 12 are arranged such that grooves 14 and 15 thereof are alternately located along the circumferential direction of cylinder 10. As shown in FIGS. 2, 3, and 5, each inner strap ring 16 is fitted in second groove portions 15*b* of grooves 15, and extends through first groove portions 14*a* of grooves 14 in a non-contact manner. Similarly, each outer strap ring 18 is fitted in second groove portions 14*b* of grooves 14, and extends through first groove portions 15*a* of grooves 15. Inner and outer strap rings 16 and 18 are soldered to vanes 12. The soldered portions of rings 16 and 18 are denoted by numeral 27. Rings 16 and 18 are held coaxially with cylinder 10.

The method of manufacturing the anode assembly having the above structure will be described.

Figure 6:
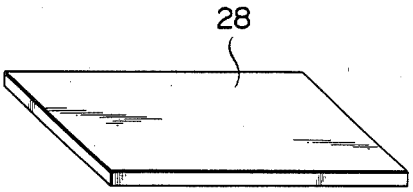
Figure 7:
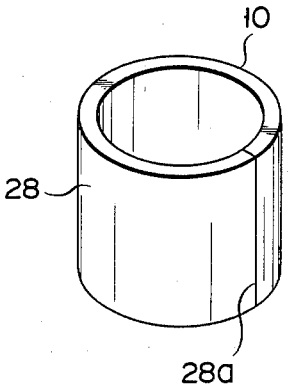
Figure 8:
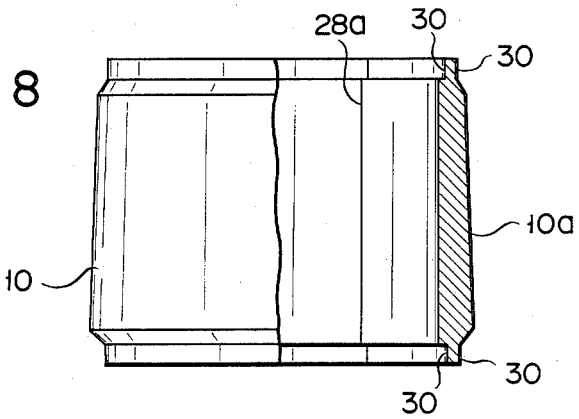

First, flat copper plate 28 for forming an anode cylinder is prepared as shown in FIG. 6. Subsequently, plate 28 is bent in a cylindrical manner as shown in FIG. 7 such that its butt connecting portion 28*a* is closed as tightly as possible. As shown in FIG. 8, the outer surface of cylinder 10 is worked to form tapered surface 10*a* so that a radiator can be easily fitted to cylinder 10. While pole pieces (not shown) are fitted on the two end portions of cylinder 10, step portions 30 for welding a metal container thereto are formed on the two end portions by drilling.

Figure 9:
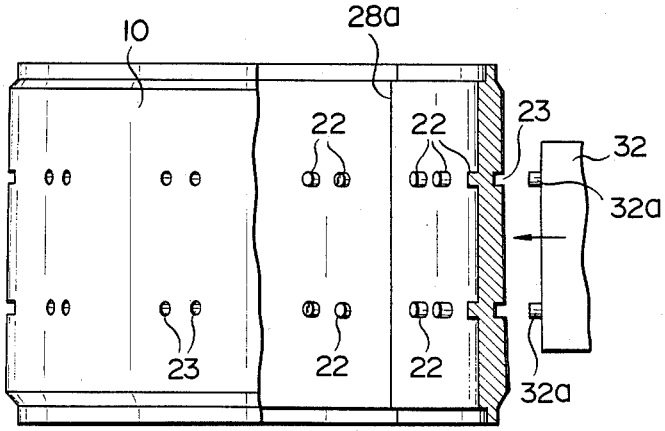

Subsequently, as shown in FIG. 9, projections 22 are formed by pressing the outer surface of cylinder 10 using press tool 32. Tool 32 has projections 32*a* formed at predetermined positions thereof. Projections 32*a* are pushed into the wall of cylinder 10 from the outside thereof by about half the thickness of the wall, and projections 22 are hence formed on the inner surface of cylinder 10. A pair of projections 22 are formed to correspond to each of the upper and lower portions of single vane 12. The distance between adjacent two projections 22 is set to be slightly larger than the thickness of vane 12 so that vane 12 can be easily inserted between projections 22.

A plurality of anode vanes 12 are prepared independently from anode cylinder 10. Each vane 12 is formed by punching a flat copper plate of a predetermined thickness into a shape shown in FIG. 4. Ten vanes 12 are prepared for single anode cylinder 10.

Figure 10:
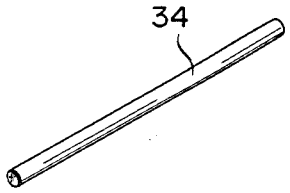
Figure 11:
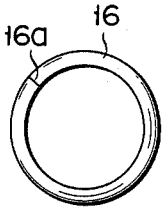
Figure 12:
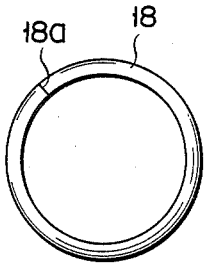

A pair of inner and outer strap rings 16 and 18 shown in FIGS. 11 and 12, respectively, are formed from copper round rod member 34 shown in FIG. 10. Rings 16 and 18 are obtained by bending member 34 to have a predetermined diameter and bringing butt portions 16*a* or 18*b* thereof in tight contact. Silver as a solder material for soldering is applied to a predetermined thickness by plating on the outer surfaces of rings 16 and 18.

Figure 13:
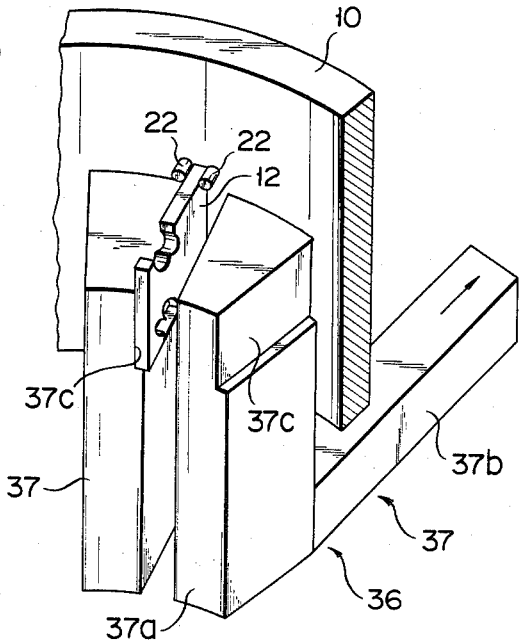
Figure 14:
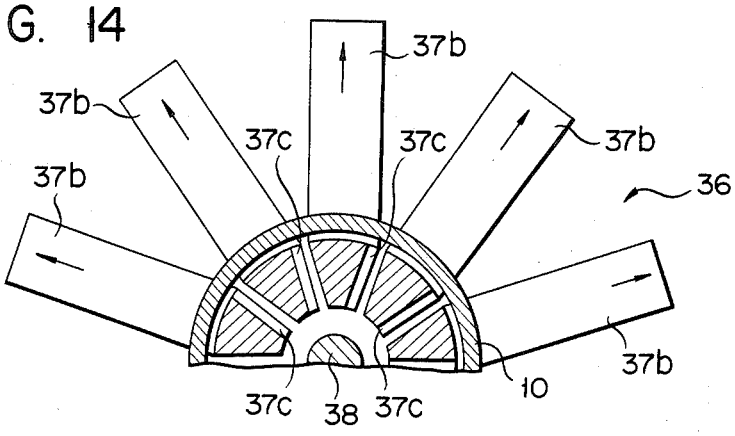
Figure 15:
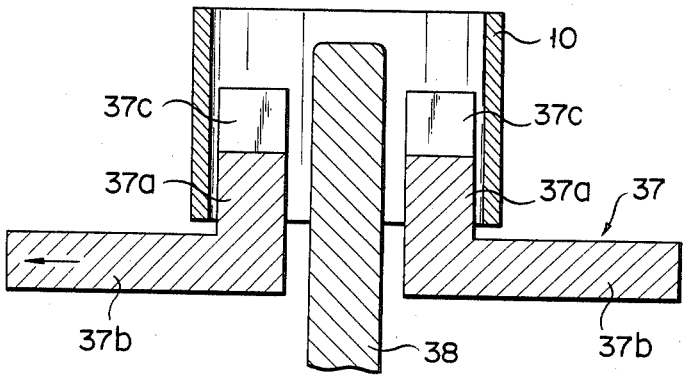

Subsequently, vane 12 is positioned at a predetermined position with respect to cylinder 10 by using a jig. More specifically, as shown in FIGS. 13 to 15, vane positioning jig 36 is fitted to cylinder 10. Jig 36 has a plurality of L-shaped elements 37. Each element 37 has vertical portion 37*a* inserted in cylinder 10 and horizontal portion 37*b* extending from the lower end of portion 37*a*. Step portion 37*c* for holding vane 12 is formed on portion 37*a*. Jig 36 is arranged such that portions 37*b* of elements 37 extend radially from cylinder 10. Elements 37 are radially opened as indicated by arrows in FIG. 14. The distance between adjacent vertical portions 37*a* is larger than the thickness of vane 12. Columnar centering jig 38 is inserted in cylinder 10 to be coaxial therewith.

Figure 16:
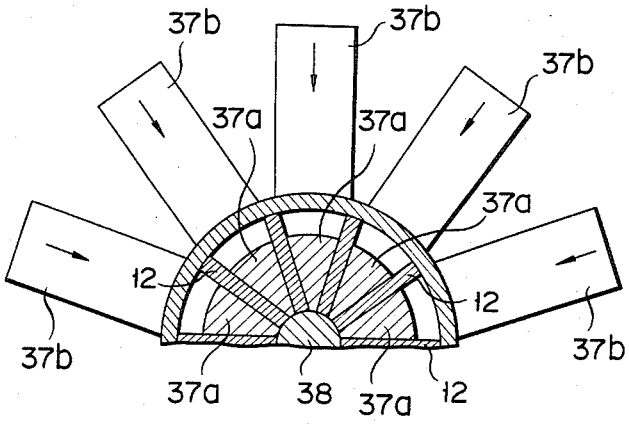
Figure 17:
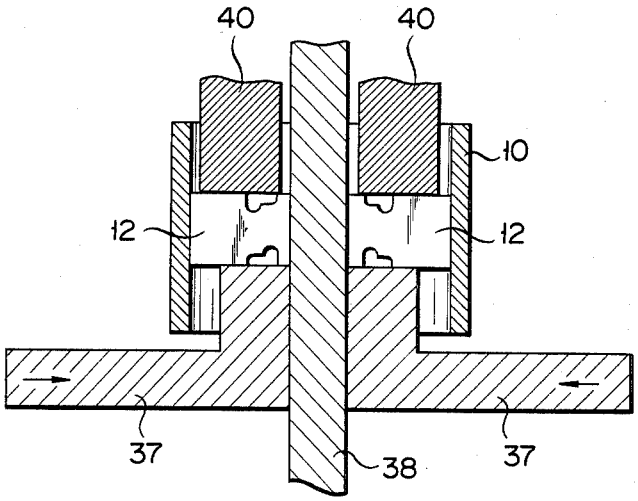

In this state, vane 12 is inserted in portion 37*c* of each element 37. At this time, each vane 12 is inserted such that its connecting end portion 12*a* is positioned between corresponding projections 22. Then, as shown in FIGS. 16 and 17, all elements 37 are moved toward the center of cylinder 10 by a predetermined distance as indicated by arrows. Upon this movement, the distance between portions 37*a* is decreased, and each vane 12 is sandwiched between portions 37*a* of adjacent elements 37. At the same time, each vane 12 is urged from upward by pressing jig 40 inserted from above cylinder 10. In this manner, each vane 12 is aligned at a predetermined position with respect to cylinder 10.

Figure 18:
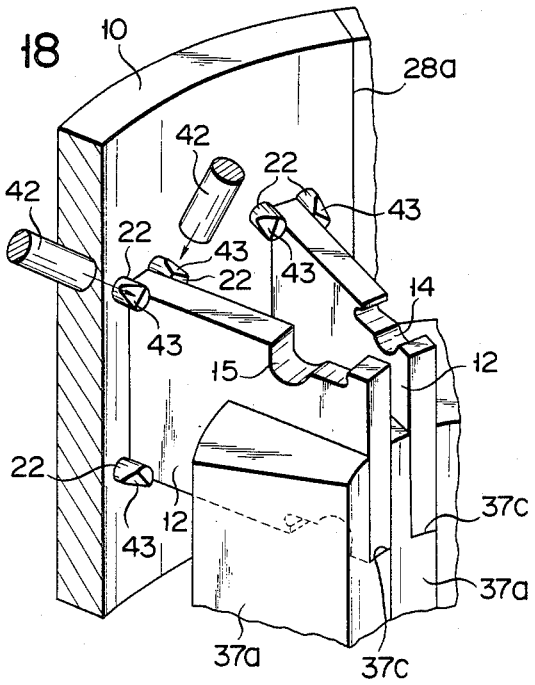

Then, projections 22 are caulked while vanes 12 are held at predetermined positions by jigs 36, 38, and 40. As a result, vanes 12 are mechanically fixed to cylinder 10 by projections 22. More specifically, as shown in FIG. 18, projections 22 are crushed from an obliquely outward direction by caulking tools 42, and each vane 12 is sandwiched by four projections 22. The caulked portion is denoted by reference numeral 43 in FIG. 18. Vane alignment and caulking can be performed by an automated machine. After vanes 12 are mechanically, preliminarily, and firmly fixed to cylinder 10 by caulking projections 22 in the manner as described above, jig 36 is opened and removed from the anode assembly together with jigs 38 and 40.

In experiments, vanes 12 were fixed using projections 22 each having a diameter of 2 mm and a height of 1 mm. It was found that each vane 12 was fixed with a sufficient strength and was not deformed even when a load of about 3 kg acted on its extended end.

Figure 19:
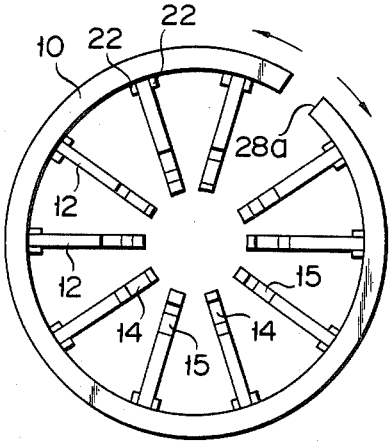

Subsequently, a pair of strap rings 16 and 18 are mounted on corresponding grooves 14 and 15 of each vane 12. In this case, as shown in FIGS. 4,5 and 19, cylinder 10 is slightly opened at the position of its butt portion 28*a* in directions indicated by arrows. In this state, outer strap ring 18 is mounted in inner portion 14*c* of second groove portion 14*b* of each mount groove 14 of vane 12. When ring 18 is mounted and the force acting on cylinder 10 is removed, butt portion 28*a* of cylinder 10 is restored to the tight contact state by spring back force of cylinder 10. Hence, ring 18 is inserted in inner portion 14*c* of each vane 12 and is fixed thereto. Note that since groove portion 14*b* has a shape and size to substantially correspond to the section of ring 18 and has overhang portion 14*d* extending from inner portion 14*c*, ring 18 is locked in portion 14*b* with mechanically stable manner so as not to be removed therefrom.

Figure 20:
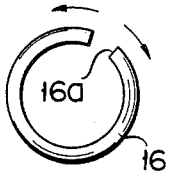

Then, as shown in FIG. 4,5 and 20 inner strap ring 16 is slightly opened at a position of its butt portion 16*a* in directions indicated by arrows. Ring 16 is then mounted in inner portion 15*c* of second groove portion 15*b* of mount groove 15 of each vane 12. When ring 16 is opened to a size slightly larger than that of a circle connecting distal ends of overhang portions 15*d*, it can be easily mounted in portions 15*c*. After mounting, ring 16 is closed by its spring back force to be inserted in portion 15*c* and is not removed from vane 12.

In this manner, strap rings 16 and 18 are preliminarily, mechanically fixed to the mount grooves of anode vanes 12.

Figure 21:
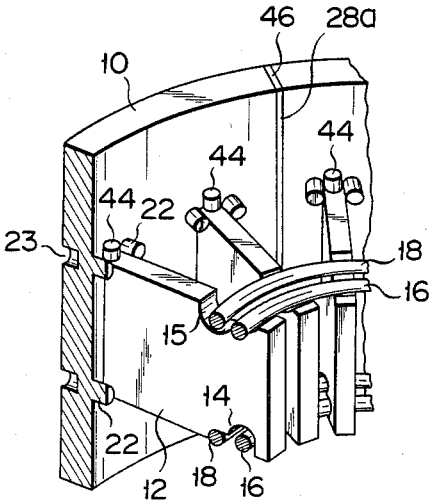
Figure 22:
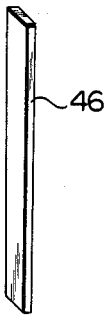
Figure 23:
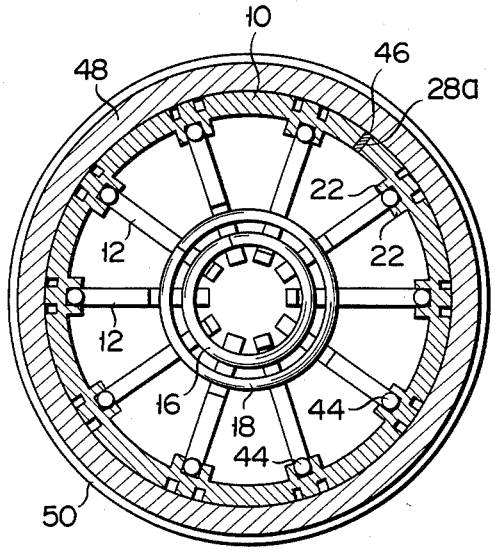
Figure 24:
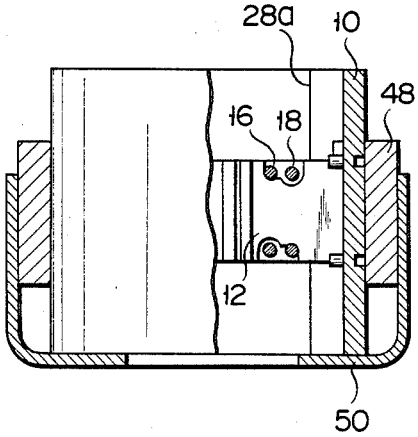

Subsequently, as shown in FIG. 21, silver solder 44 is applied to the connecting portions of anode cylinder 10 and vanes 12 and, more specifically, to the portions in the vicinity of projections 22. Ribbon-like solder 46 shown in FIG. 22 is inserted in butt portion 28*a* of cylinder 10 while the butt portion is opened as shown in FIG. 19. When butt portion 28*a* is closed by spring back force of cylinder 10, solder 46 is clamped in portion 28*a*. Then, as shown in FIGS. 23 and 24, annular regulating tool 46 is fitted around cylinder 10, and the anode assembly with tool 48 mounted thereon is provided in support cylinder 50.

The anode assembly in this state is heated in a soldering high-temperature furnace for about 3 to 4 hours. Solders 44 and 46 and solder material applied on rings 16 and 18 are thus melted, and cylinder 10 and vanes 12, and vanes 12 and rings 16 and 18 are soldered.

The anode assembly of the magnetron is manufactured according to the above steps.

According to the manufacturing method described above, vanes 12 are mechanically, preliminarily fixed to cylinder 10 by caulking projections 22, and thereafter vanes 12 and cylinder 10, and vanes 12 and strap rings 16 and 18 are soldered without using a positioning jig. Therefore, cylinder 10 can be connected with vanes 12 at room temperature, and thermal strain does not occur at the respective components during connecting. Since the positioning jig is used at room temperature, positioning precision is not degraded by the thermal expansion of the positioning jig, unlike in a conventional case. As a result, an anode assembly having anode vanes positioned a considerably high precision can be manufactured. In addition, since the positioning jig is not used for soldering, it need not be formed with an expensive material considering the influence of heat. Also, the number of positioning jigs can be reduced, thereby reducing the manufacturing costs. Furthermore, the caulking/fixing step can be efficiently performed with an automated machine, and strength of caulking can be easily controlled. As a result, an anode assembly having a small variation and a uniform fixing strength can be efficiently manufactured on a large scale.

Each ring mount groove of the anode vanes has a groove portion having a shape and size substantially corresponding to the section of the ring, and an overhang portion projecting into the groove portion. Therefore, the ring can be mechanically held by the anode vanes with stability only by fitting the same in the groove portion. No undesirable thermal strain occurs in the strap ring during soldering to deform the same, and no special jig is needed for supporting the strap ring. This facilitates the manufacture of the anode assembly and further decreases the manufacturing costs.

In this manner, the above-described manufacturing method allows highly precise positional relationships among the constituent components, and is suitable for mass production.

The present invention is not limited to the above embodiment. Various changes and modifications may be made within the scope of the present invention.

Figure 25:
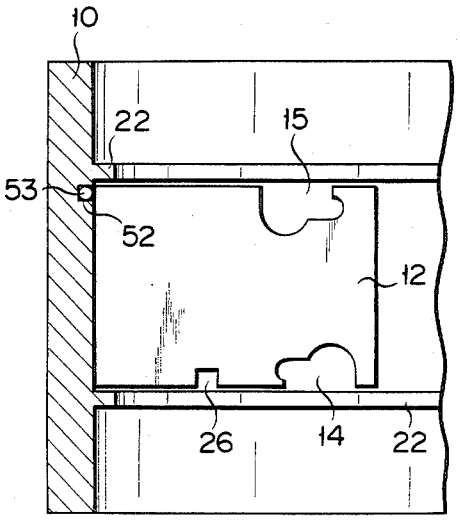
FIGS. 25 and 26 are sectional and side views, respectively, for schematically showing a first modification of the vane fixing projection.
Figure 26:
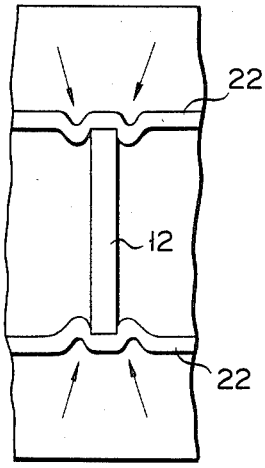

In the above embodiment, the vane-fixing projections are formed to have a columnar shape. However, the shape of the projections is not limited to this. For example, as shown in FIGS. 25 and 26, a pair of annular projections can be formed as vane-fixing projections 22 on the inner surface of cylinder 10 to be coaxial therewith. In this case, each vane 12 is arranged between projections 22. When predetermined portions of projections 22 are caulked, vanes 12 are preliminarily fixed to cylinder 10. Annular groove 52 is formed in the inner surface of cylinder 10 between projections 22. Solder material 53 is housed in groove 52. Strap rings are mounted in anode vanes 12 in the same manner as in the above embodiment, and the anode assembly is soldered without using a positioning jig.

Figure 27:
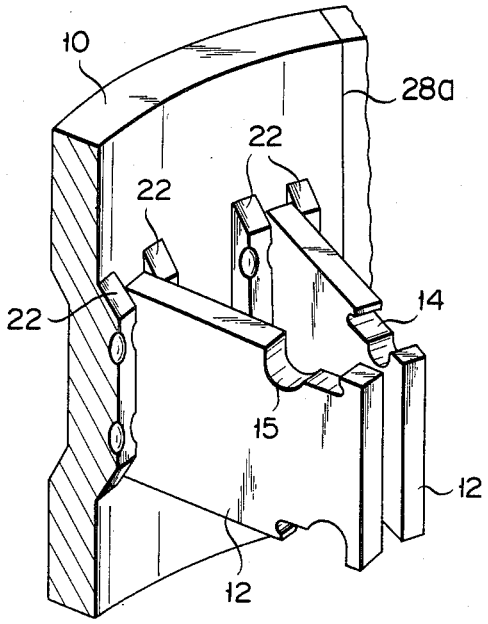
FIG. 27 is a perspective view showing a second modification of the vane fixing projection.

As shown in FIG. 27, a plurality of elongate projections extending along the axial direction of cylinder 10 can also be used as vane fixing projections 22. In this case, connecting end portion 12*a* of each vane 12 is inserted between a corresponding pair of projections 22. When two portions (caulking portions 22*a*) of each projection 22 are caulked, end portion 12*a* is fixed between projections 22. In this case, the contact area of projections 22 with vanes 12 is increased, thereby fixing vanes 12 further firmly.

Figure 28:
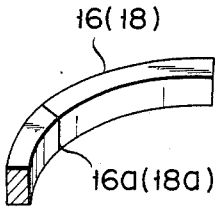
FIG. 28 is a perspective view showing a modification of the strap ring.
Figure 29:
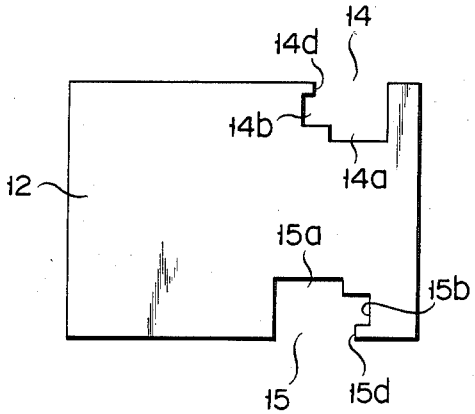
FIG. 29 is a plan view showing a modification of the vane.

A strap ring can have a rectangular section, as shown in FIG. 28. In this case, the groove portions of mount grooves 14 and 15 as well are formed to have rectangular sections to correspond to strap rings 16 and 18, as shown in FIG. 29.

In FIGS. 25 to 29, the same reference numerals as in the above embodiment denote the same parts as in the above embodiment, and a detailed description thereof is omitted.

What is claimed is:

1. An anode assembly of magnetron, comprising:

an anode cylinder having a pluraltiy of projections protruding from an inner surface thereof each projection being formed by pressing part of a wall of the anode cylinder from an outer side toward an inner side a plurality of plate-like anode vanes radially extending from said inner surface of said anode cylinder toward a center thereof and provided at predetermined angular intervals along a circumferential direction of said anode cylinder, each of said vanes havign a connecting end portion with four corners engaged with the inner surface of said anode cylinder, four projections being provided per anode vane so as to engage with the four corners of the connecting end portion of the anode vanes, said connecting end portion being mechanically fixed to said inner surface of said anode cylinder by caulking said projections engged therewith, and being electrically connected to said anode cylinder by soldering and a plurality of strap rings, fixed to said anode vanes, for electrically short-circuiting every other ones of said anode vanes, respectively.

2. An anode assembly according to claim 1, wherein each of said projections has a columnar shape.

3. An anode assembly according to claim 1, wherein each of said anode vanes has a strap ring mount groove, said mount groove having a groove portion and an overhang portion, said groove portion having a shape and size substantially the same as those of a section of each of said strap ring and fitted with said strap ring, said overhang portion extending into said groove portion to prevent said strap ring from being removed from said groove portion.

4. An anode assembly according to claim 1, wherein said anode cylinder is formed by preparing a plate member having a rectangular shape and bending the plate member in a cylindrical manner such that a butt portion thereof is in tight contact with each other.

5. A method of manufacturing an anode assembly of a magnetron, comprising the steps of:

preparing an anode cylinder and a plurality of plate-like anode vanes;

pressing part of a wall of the anode cylinder from an outer side toward an inner side thereof and thereby forming a plurality of projections on the inner surface of said anode cylinder, four projections per anode vane, and forming holes corresponding to the projections on said outer side;

aligning said anode vanes at predetermined positions with respect to said anode cylinder by using a positioning jig such that a connecting end portion of each of said anode vanes is engaged with said inner surface of said anode cylinder and four corners of the connecting end portion are engaged with the corresponding four projection, respectively;

caulking said projections while holding said anode vanes with said positioning jig to mechanically fixe said anode vanes to said anode cylinder;

removing said jig from said anode vanes; and soldering said connecting end portion of each of said anode vanes to said cylinder to electrically connect each of said anode vanes to said anode cylinder.

6. A method according to claim 5, which further comprises the steps of: preparing an inner strap ring and an outer strap ring; mounting said inner and outer strap rings on said anode vanes fixed to said anode cylinder; and soldering said inner and outer strap rings to said aonde vanes, thereby electrically short-circuiting every other ones of said anode vanes.

7. A method according to claim 6, wherein the step of preapring said anode cylinder includes a step of preparing a plate member having a rectangular shape and bending the plate member in a cylindrical manner such that a butt portion thereof is in tight contact with each other and said strap ring mounting step further includes air-tightly sealing the butt portion after mounting said strap rings on said anode vanes.

8. A method according to claim 6, wherein step of preparing said anode vanes includes a process of punching a anode vane having a strap ring mount groove from a plate member, said mount groove having a first and second circular cut-out sections overlapped each other and an overhang portion, said first circular cut-out section having a shape and size substantially the same as those of a section of said strap ring, and said overhang portion projecting into said first section, the step of preparing said anode cylinder includes a process of preparing a plate member having a rectangular shape, and a process of bending said plate member in a cylindrical manner such that a butt portion thereof is in tight contact with each other; the step of preparing said strap ring includes a process or preparing a rod-like member, and a process of bending said member in a ring-like manner such that a butt portion thereof is in tight contact with each other; and the mounting step includes a process of opening said butt portion of said anode cylinder, a process of mounting said outer strap anode cylinder, a process of mounting said out strap ring in said first cut-out sections of said anode vanes, a process of closing said anode cylinder by its elasticity so as to insert said outer strap ring in said first cut-out sections, a process of mounting said inner strap ring in said first cut-out sections of said anode vanes while said butt portion of said inner strap ring is open, and a process of closing said inner strap ring by its elasticity and inserting said inner strap ring in said first cut-out sections.

9. A method according to claim 7, wherein said projections are formed by bending the plate member.

* * * * *